US009707755B2

(12) United States Patent
Izawa et al.

(10) Patent No.: US 9,707,755 B2
(45) Date of Patent: Jul. 18, 2017

(54) METHOD FOR CONTROLLING INKJET PRINTING APPARATUS

(71) Applicant: MIYAKOSHI PRINTING MACHINERY CO., LTD., Narashino-shi, Chiba (JP)

(72) Inventors: Hideo Izawa, Narashino (JP); Yasushi Katagiri, Narashino (JP); Seiji Komatsuda, Yokote (JP)

(73) Assignee: MIYAKOSHI PRINTING MACHINERY CO., LTD., Narashino-shi, Chiba (JP)

( * ) Notice: Subject to any disclaimer, the term of this patent is extended or adjusted under 35 U.S.C. 154(b) by 0 days.

(21) Appl. No.: 14/824,707

(22) Filed: Aug. 12, 2015

(65) Prior Publication Data

US 2016/0263891 A1 Sep. 15, 2016

(30) Foreign Application Priority Data

Mar. 13, 2015 (JP) ..... 2015-51457

(51) Int. Cl.
*B41J 2/14* (2006.01)
*B41J 2/045* (2006.01)

(52) U.S. Cl.
CPC ..... *B41J 2/14233* (2013.01); *B41J 2/04541* (2013.01); *B41J 2/04581* (2013.01); *B41J 2/04588* (2013.01); *B41J 2/04596* (2013.01)

(58) Field of Classification Search
CPC B41J 2/14233; B41J 2/04541; B41J 2/04581; B41J 2/045
(Continued)

(56) References Cited

U.S. PATENT DOCUMENTS 5,541,628 A * 7/1996 Chang ..... B41J 2/04541 347/10
6,386,664 B1 5/2002 Hosono et al.
(Continued)

FOREIGN PATENT DOCUMENTS

EP 1 138 500 A2 10/2001
JP 2001-121722 A 5/2001
(Continued)

OTHER PUBLICATIONS

European Search Report issued in corresponding application No. 15180723.7, dated Sep. 22, 2016 (8 pgs.).

*Primary Examiner* — Julian Huffman
*Assistant Examiner* — Michael Konczal
(74) *Attorney, Agent, or Firm* — Flynn, Thiel, Boutell & Tanis, P.C.

(57) ABSTRACT

A method for controlling an inkjet printing apparatus performing printing to an elongated printing medium 11, the method having a discharging step of performing continuous application to a piezoelectric element 23 of a nozzle to be used with a pulse number of two or more waves per one printing element to deform the piezoelectric element and thereby discharge ink in an ink chamber 22 from an opening portion 21, and a vibrating step of performing application of the piezoelectric elements 23 to all the nozzles with a pulse number of one wave per one printing element to deform the piezoelectric elements, thereby imparting only vibrations to the inks in the ink chambers 22 without discharging the inks, where the discharging step and the vibrating step are performed alternately.

7 Claims, 7 Drawing Sheets

(58) Field of Classification Search
USPC ..... 347/9, 10
See application file for complete search history.

(56) References Cited

U.S. PATENT DOCUMENTS

| | | | | |
|---|---|---|---|---|
| 6,419,336 | B1 | 7/2002 | Takahashi | |
| 6,431,674 | B2 | 8/2002 | Suzuki et al. | |
| 6,494,556 | B1 | 12/2002 | Sayama et al. | |
| 6,715,852 | B2 | 4/2004 | Yonekubo | |
| 8,613,489 | B2 * | 12/2013 | Tsukamoto | B41J 2/04581 347/10 |
| 2002/0012017 | A1 | 1/2002 | Yonekubo | |
| 2003/0067500 | A1 | 4/2003 | Fujimura et al. | |
| 2007/0285448 | A1 | 12/2007 | Nakamura | |
| 2008/0117245 | A1 | 5/2008 | Nishimura | |
| 2011/0279501 | A1 * | 11/2011 | Mitsuki | B41J 2/04581 347/10 |
| 2014/0210885 | A1 * | 7/2014 | Furukawa | B41J 2/04588 347/10 |
| 2015/0116400 | A1 * | 4/2015 | Sasaki | B41J 2/04588 347/10 |

FOREIGN PATENT DOCUMENTS

| | | | |
|---|---|---|---|
| JP | 2001-260369 | A | 9/2001 |
| JP | 2001-341326 | A | 12/2001 |
| JP | 2003-175605 | A | 6/2003 |
| JP | 2010-184363 | A | 8/2010 |

* cited by examiner

FIG.3 ( a )
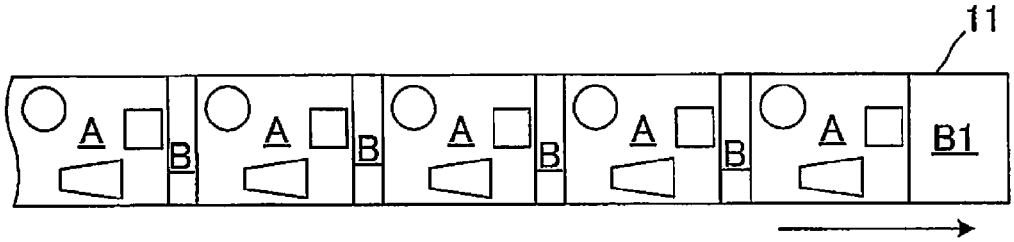
FIG.3( b )
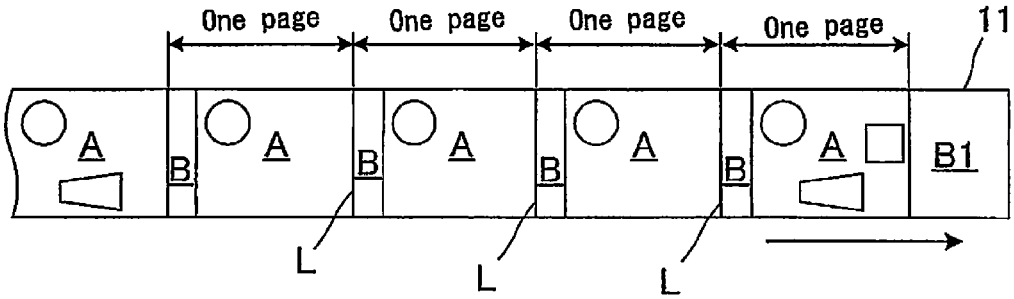

FIG.4 ( a )
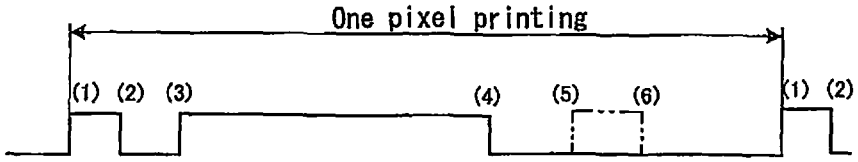
FIG.4( b )
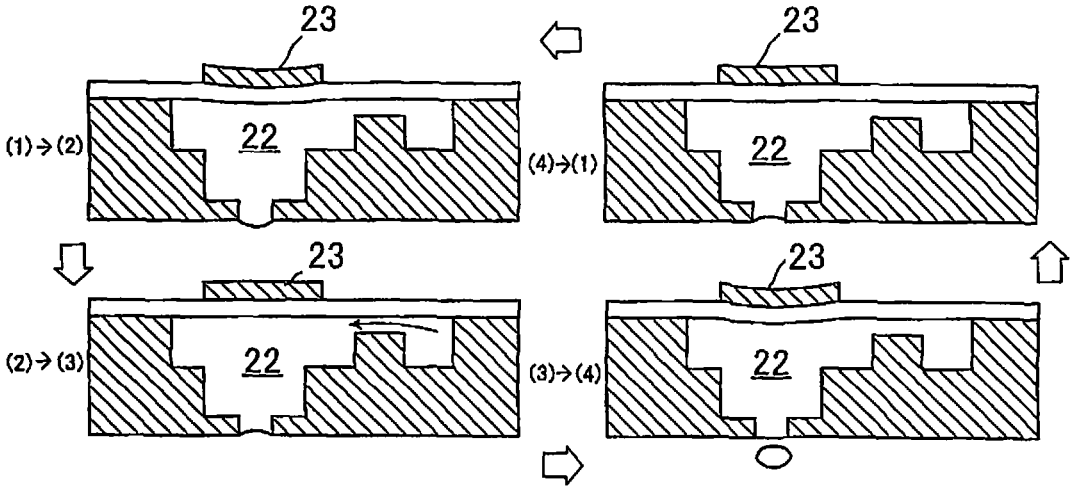

FIG.6 ( a )
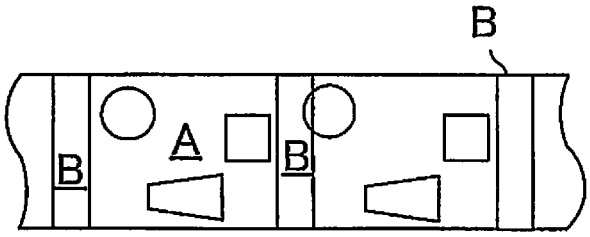
FIG.6( b )
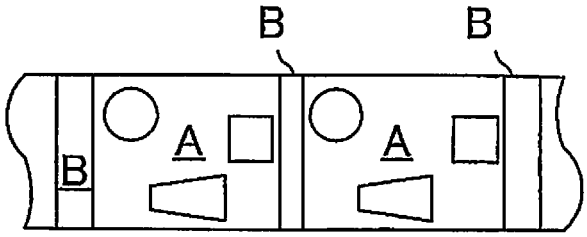

METHOD FOR CONTROLLING INKJET PRINTING APPARATUS

TECHNICAL FIELD

The present invention relates to a method for controlling an inkjet printing apparatus, and in particular to a method for controlling an inkjet printing apparatus which prevents discharge defects in all of the nozzles and is also excellent in production efficiency.

BACKGROUND ART

In an inkjet printing system of a piezo system, ink filled in an ink chamber is pushed out due to deformation of a piezoelectric element applied with a voltage so that ink is discharged from a nozzle.

Now, in the inkjet printing apparatus, since printing is performed to form an image, of course, printing is not performed to a portion where an image is absent.

Therefore, such an event occurs that even if a nozzle by which printing is not performed is in operation of the inkjet printing apparatus, ink on a nozzle surface (particularly, a meniscus portion) gradually evaporates and the ink dries so that solid content in the ink precipitates to adhere to an opening portion of the nozzle.

As a result, when the nozzle is used, there is a possibility of causing such a discharge defect that the ink cannot be discharged straightly due to clogging in the nozzle or a partial clogging therein.

On the other hand, an image-forming apparatus provided with a pressure application portion which performs a discharge action for discharging an ink drop from a nozzle and a swinging action which swings a meniscus of ink but does not discharge an ink drop is known (for example, see PTL1).

According to such an image-forming apparatus, prior to performing printing on a certain page, by swinging a meniscus of a nozzle corresponding to a printed pixel and maintaining a meniscus of a nozzle corresponding to a pixel which is not printed in a resting state, a discharge defect is hard to occur when printing is performed on the next page using a nozzle which did not discharge in printing the previous page.

CITATION LIST

Patent Literature

PTL 1: Japanese Patent Application Laid-Open No. 2010-184363

SUMMARY OF INVENTION

Technical Problem

However, in the image forming apparatus described in PTL1, there is a possibility that a nozzle which is not used causes clogging in the nozzle because a meniscus thereof is maintained in a resting state.

For example, when a change between images to be printed is performed and a change between nozzles to be used is performed according to lot exchange or the like, since a nozzle which is not used until then may cause a discharge defect, it cannot be used immediately. In particular, when a printing head is a line head of a fixed type, since ink tends to dry more easily than a printing head of a serial type where restoring a discharge such as purging in a non-discharge region is possible, a discharge defect occurs easily.

Further, since the above image-forming apparatus is a so-called sheet feed printing machine, where swinging of a meniscus is performed in a region between sheets before page printing, a sufficient space is required between mediums to be printed in order to perform swinging securely, and a printing time loss occurs, which cannot be said to be excellent in production efficiency.

The present invention has been made in view of the above circumstances, and an object of the present invention is to provide a method for controlling an inkjet printing apparatus which can prevent nozzle discharge defects in all nozzles and is excellent in production efficiency.

Solution to Problems

The present inventor has made intensive research to solve the above problems and has completed the present invention based upon the finding that the above problems can be solved by performing a vibrating step to all nozzles when printing is performed on an elongated printing medium.

The present invention lies in (1) a method for controlling an inkjet printing apparatus for performing printing to an elongated printing medium, the inkjet printing apparatus being provided with a printing head having a plurality of nozzles composed of an opening portion from which ink is discharged, an ink chamber communicating with the opening portion to accommodate ink, and a piezoelectric element attached to the ink chamber via a vibrating plate, the method including: a discharging step of performing continuous application to a piezoelectric element of a nozzle to be used with a pulse number equal to or more than two waves per one printing pixel to deform the piezoelectric element, thereby discharging ink in the ink chamber from the opening portion; and a vibrating step of performing application to the piezoelectric elements of all nozzles with a pulse number of one wave per one printing pixel to deform the piezoelectric elements, thereby imparting only vibrations to the inks in the ink chambers without discharging the inks; wherein the discharging step and the vibrating step are performed alternately.

The present invention lies in (2) the method for controlling an inkjet printing apparatus according to the above (1), wherein the printing head is a line head of a fixed type.

The present invention lies in (3) the method for controlling an inkjet printing apparatus according to the above (1) or (2), wherein the inkjet printing apparatus is provided with a selector for adjusting a time period for performing application to the piezoelectric element.

The present invention lies in (4) the method for controlling an inkjet printing apparatus according to any one of the above (1) to (3), wherein the vibrating step is a step of continuously performing vibration application for a fixed time period.

The present invention lies in (5) the method for controlling an inkjet printing apparatus according to any one of the above (1) to (4), wherein the inkjet printing apparatus is an apparatus configured so as to perform printing based upon printing data having an image portion and a non-image portion, and the discharging step is set so as to be performed to the image portion, while the vibrating step is set so as to be performed to the non-image portion.

The present invention lies in (6) the method for controlling an inkjet printing apparatus according to the above (5), wherein the non-image portion is set with a fixed cycle.

The present invention lies in (7) the method for controlling an inkjet printing apparatus according to the above (5), wherein the non-image portion is set with a fixed cycle as much as possible and when an image is present in the non-image portion, the discharging step is prioritized to only a portion corresponding to the image and the vibrating step is set to the other portion of the non-image portion.

The present invention lies in (8) the method for controlling an inkjet printing apparatus according to the above (5), wherein the printing is performed at a page unit, and a margin of a previous page side, a margin of the next page side, or a margin connecting the previous page side and the next page side is set as the non-image portion.

Advantageous Effects of Invention

In the method for controlling an inkjet printing apparatus of the present invention, by performing the vibrating step to all the nozzles, even if a nozzle is not used, a discharge defect of the nozzle can be prevented in preparation for the next printing. That is, even if ink on a nozzle surface gradually evaporates due to the vibrating step, the ink in the nozzle chamber is stirred by the vibrations, so that precipitation of the solid content in the ink can be suppressed.

Thereby, for example, even if a change between images to be printed is performed and a change between nozzles to be used is performed according to a lot exchange of products to be printed or the like, a nozzle which is not used until then can be used immediately under an optimal condition.

Now, when the printing head is a line head of a fixed type, since the printing head itself is unmovable, a discharge defect tends to occur in a nozzle which is being not used particularly easily as compared with one in the above line head of a serial type.

Therefore, an effect obtained by the vibrating step in this case become considerably large.

Further, in the above method for controlling an inkjet printing apparatus, when printing is performed on an elongated printing medium, a wasteful space can be reduced and lowering of a production efficiency can be suppressed by alternately performing the discharging step and the vibrating step under an optimal condition.

Furthermore, in the above method for controlling an inkjet printing apparatus, since it is unnecessary to set a vibrating step for each nozzle, unlike the conventional art, printing data can be made relatively simple.

Now, in the above conventional image-forming apparatus, since it is necessary to analyze image data and set the discharging action, the swinging action, and the resting action to each nozzle, there is such a fault that printing data obtained by converting the image data becomes vast and much time is required for preparation of the image data.

In the method for controlling an inkjet printing apparatus of the present invention, since the inkjet printing apparatus is provided with a selector for adjusting a time period of application to the piezoelectric elements, the time period can be easily controlled and it is made possible to apply voltages to the piezoelectric elements instantaneously. Incidentally, the term "application" means applying a voltage.

In the method for controlling an inkjet printing apparatus of the present invention, since the vibrating step is the step of applying vibrations for a fixed time period, the application of vibrations having a sufficient time period is made possible in response to such a factor as a waiting time up to a printing start, a page length, or a printing coverage. Thereby, the discharge defect of a nozzle can be securely prevented.

Further, even if nozzle clogging occurs, the clogging can be solved.

In the method for controlling an inkjet printing apparatus of the present invention, since the inkjet printing apparatus is configured so as to perform printing based upon printing data having an image portion and a non-image portion, and the vibrating step only needs to be performed to an elongated printing medium during the timing of the non-image portion set arbitrarily by making the setting so as to perform the discharging step to the image portion and making the setting so as to perform the vibrating step to the non-image portion, inkjet printing can be performed at an optimal condition.

In the method for controlling an inkjet printing apparatus of the present invention, by setting the non-image portion at a fixed cycle, the vibrating step can be controlled easily and production of printing data is made easy.

Further, when the non-image portion is set with a fixed cycle as much as possible and an image is present in the non-image portion, the production efficiency can be prevented from lowering by prioritizing the discharging step regarding only a portion corresponding to the image and performing the vibrating step to the other portion of the non-image portion.

In the method for controlling an inkjet printing apparatus of the present invention, printing is performed at each page unit, where a margin of a previous page side, a margin of the next page side, or a margin connecting the previous page side and the next page side is set as the non-image portion, so that production of printing data is further simplified.

BRIEF DESCRIPTION OF DRAWINGS

FIGS. 3(*a*) and 3(*b*) are descriptive diagrams showing printing data set to the printing medium in the method for controlling an inkjet printing apparatus according to the embodiment;

FIG. 4(*a*) is a waveform showing a pulse per one printing pixel in a discharging step of the method for controlling an inkjet printing apparatus according to the embodiment, and FIG. 4(*b*) is schematic sectional views showing states of a nozzle at times (1) to (4) in FIG. 4(*a*);

FIGS. 6(*a*) and 6(*b*) are descriptive diagrams for describing a processing method performed when an image has entered the non-image portion of the printing data in the method for controlling an inkjet printing apparatus according to the embodiment.

DESCRIPTION OF EMBODIMENTS

Hereinafter, with reference to the Figures, if necessary, preferred embodiments of the present invention will be described in detail. It should be noted that in the Figures, identical elements are denoted by identical reference signs so that the same description is not repeated. In addition, positional relationships, such as top and bottom or right and left, are based upon positional relationships in the Figures, unless otherwise noted. Further, the dimensional ratios of the drawings and ratios of illustrations are not limited to those shown in the Figures.

Figure 1:
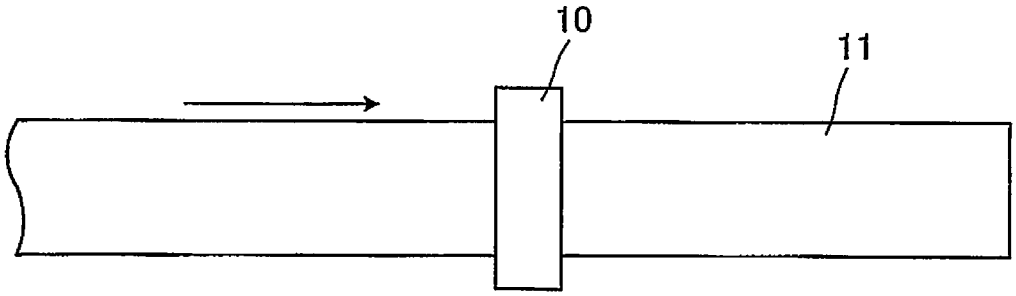
FIG. 1 is a schematic top view showing a printing head of an inkjet printing apparatus and a printing medium used for a method for controlling an inkjet printing apparatus according to an embodiment of the present invention.

FIG. 1 is a schematic top view showing a printing head of an inkjet printing apparatus and a printing medium used in a method for controlling an inkjet printing apparatus according to an embodiment of the present invention.

As shown in FIG. 1, in an inkjet printing apparatus used in the method for controlling an inkjet printing apparatus according to the embodiment, printing is performed on a continuous elongated printing medium 11 by a printing head 10.

Here, the printing head 10 is composed of a line head of a fixed type, and a plurality of nozzles (not shown) are provided on a lower face of the printing head 10 along a widthwise direction of the printing head 10 (a widthwise direction of the printing medium 11).

Therefore, in the inkjet printing apparatus, ink is applied to the printing medium 11 by causing the printing medium 11 to run in a perpendicular direction to the widthwise direction of the printing head 10 and discharging ink from the nozzles of the printing head 10.

Figure 2:
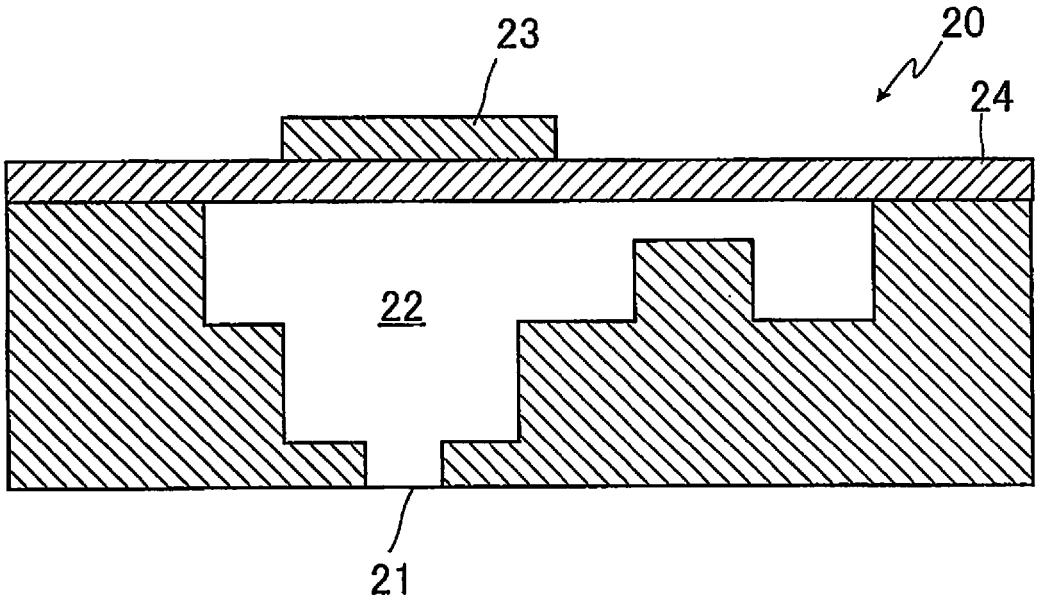
FIG. 2 is a schematic sectional view showing an inside of one of a plurality of nozzles provided in the printing head of the inkjet printing apparatus used for the method for controlling an inkjet printing apparatus according to the embodiment.

FIG. 2 is a schematic sectional view showing an inside of one of a plurality of nozzles provided in the printing head of the inkjet printing apparatus used for the method for controlling an inkjet printing apparatus according to the embodiment. It should be noted that since the other nozzles have the same structure, explanation thereof is omitted.

As shown in FIG. 2, the nozzle 20 is composed of an opening portion 21 from which ink is discharged, an ink chamber 22 communicating with the opening portion 21 to accommodate ink therein, and a piezoelectric element 23 attached to the ink chamber 22 via a vibrating plate 24. It should be noted that all of the plurality nozzles provided in the printing head 10 have the same structure.

In the nozzle 20, when a voltage is applied to the piezoelectric element 23 by a piezo actuator 34 (see FIG. 7) described later, the piezoelectric element is deformed and the vibrating plate 24 is also deformed according to the deformation.

Thereby, since the volume in the ink chamber 22 is changed, ink filled in the ink chamber 22 is pushed out so that ink is discharged from the opening portion 21. It should be noted that details of a mechanism of ink discharge will be described later.

Therefore, in the inkjet printing apparatus, printing is performed according to a piezo system.

It should be noted that the above ink is not limited to a specific one, but for example, aqueous dye, aqueous pigment, oily dye, oily pigment or the like can be used.

In the method for controlling an inkjet printing apparatus according to the embodiment, first, printing data corresponding to the inkjet printing apparatus is produced based upon image data corresponding to an image required.

FIG. 3(*a*) is a descriptive diagram showing printing data set to a printing medium in the method for controlling an inkjet printing apparatus according to the embodiment.

As shown in FIG. 3(*a*), the printing data has image portions A and non-image portions B, and is set to the printing medium 11.

Here, the image portion A is a region on which an image should be formed by discharging ink, while the non-image portion B is a region on which an image is not formed without discharging ink.

In the method for controlling an inkjet printing apparatus, setting is made so as to perform a discharging step to the image portions A while setting is made so as to perform a vibrating step to the non-image portions B. In other words, setting is made so as to perform the discharging step at timings at which the image portions A set in the printing medium 11 to be fed pass through below the printing head 10 and setting is made so as to perform the vibrating step at timings at which the non-image portions B set in the printing medium 11 to be fed pass through below the printing head 10.

At this time, setting is made such that the discharging step and the vibrating step are alternately performed. Thereby, when the non-image portion B passes through below the printing head 10, ink can be prevented from drying.

Further, a wasteful space can be cut and the production efficiency can be improved by preforming the discharging step and the vibrating step to the elongated printing medium alternately under an optimal condition.

It should be noted that, when one non-image portion B indicated in FIG. 3(*a*) is focused on, the above-described vibrating step is not required to be performed on a whole region of the non-image portion B necessarily, and it only needs to be performed to a portion within the region of the non-image portion B. That is, the vibrating step only needs to be performed at an exact timing at which the portion within the non-image portion B set in the printing medium 11 to be fed passes through below the printing head 10.

Thereby, it is made possible to narrow the region of the non-image portion to be subjected to the vibrating step as much as possible, which results in an improvement of the production efficiency.

In the method for controlling an inkjet printing apparatus, setting is made prior to an operation of the inkjet printing apparatus such that the vibrating step is first performed.

Further, it is preferable that the vibrating step prior to the operation is performed for a time period longer than the vibrating step performed during the discharging step (namely, the portion of the non-image portion B1 in FIG. 3(*a*)).

Thereby, a discharge defect of the nozzle can be securely prevented from occurring during the discharging step.

Further, as shown in FIG. 3(*b*), it is possible to delimit the printing medium at a page border L to perform printing for each page. It should be noted that the length of one page is properly set by a setting machine (not shown).

For example, production of the printing data can be further simplified by setting a margin on the previous page side just before a page border L as a non-image portion.

FIG. 4(*a*) is a waveform showing a pulse per one printing pixel in the discharging step of the method for controlling an inkjet printing apparatus according to the embodiment, and FIG. 4(*b*) is schematic sectional views showing states of a nozzle at times (1) to (4) in FIG. 4(*a*).

Figure 5:
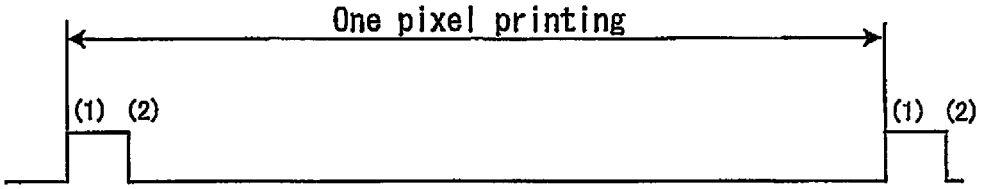
FIG. 5 is a waveform showing a pulse per one printing pixel at the vibrating step of the method for controlling an inkjet printing apparatus according to the embodiment.

FIG. 5 is a waveform showing pulses per one printing pixel in the vibrating step of the method for controlling an inkjet printing apparatus according to the embodiment.

It should be noted that the voltages to be applied in the discharging step and the vibrating step are fixed in the method for controlling an inkjet printing apparatus.

Further, the application times of the voltages are controlled by a selector 33*d* (see FIG. 7) of an image rendering portion 33 described later. The application times of the voltages to the piezoelectric element in both steps can be controlled easily by using the selector 33*d* of the image-rendering portion 33.

As shown in FIGS. 4(*a*) and 4(*b*), ink in the ink chamber is discharged from the opening portion in the discharging step by performing continuous application with the pulse number of two or more waves per one printing pixel to deform the piezoelectric element.

First, application to the piezoelectric element is performed based upon a pulse of the first wave ((1)→(2) in FIGS. 4(*a*) and 4(*b*)). Thereby, the piezoelectric element moves in a direction of pushing out the ink in the ink chamber. It should be noted that the ink is not discharged by the movement.

Next, by terminating the application based upon the pulse of the first wave ((2)→(3) in FIGS. 4(*a*) and 4(*b*)), the deformation of the piezoelectric element is returned to its original shape so that ink flows into the ink chamber which becomes negative pressure.

Then, application to the piezoelectric element is performed based upon a pulse of the second wave ((3)→(4) in FIGS. 4(*a*) and 4(*b*)).

Thereby, the piezoelectric element moves in a direction of pressing out ink in the ink chamber so that the ink is discharged.

Next, by terminating the application based upon the pulse of the first wave ((4)→(1) in FIGS. 4(*a*) and 4(*b*)), the deformation of the piezoelectric element is returned to its original shape so that ink flows into the ink chamber which becomes negative pressure.

It should be noted that by subsequently performing application to the piezoelectric element based upon a pulse of the third wave ((5)→(6) in FIG. 4(*a*)), inks are continuously discharged.

Here, the term "the pulse number" in the present invention means the number of rectangular waves having a constant width, and the term "continuous application" means that the pulse of the second wave is generated within at least 3 μsec after the pulse of the first wave is generated.

Such a discharging step is continuously performed to the whole region of the image portion A, so that the image portion A is formed.

It should be noted that since the ink in the ink chamber always flows in the discharging step, precipitation of the solid content in the ink hardly occurs.

As shown in FIG. 5, in the discharging step, application to the piezoelectric elements of all the nozzles is performed with the pulse number of one wave per one printing pixel to deform the piezoelectric elements. In this case, as described above, the piezoelectric elements move in a direction of pressing out inks in the ink chambers but the inks are not discharged. Thereby, small vibrations can be applied to the inks and inks are not discharged from the opening portions so that the inks are each mixed within the ink chambers.

Here, it is preferable that the vibrating step is configured so as apply vibrations for a fixed time period repeatedly. Thereby, it becomes possible to prevent the clogging of the nozzles.

Further, the vibrating step can be set with a proper time period corresponding to such a variable factor as a waiting time before printing starts, or a page length, a print coverage, or the like.

For example, in the vibrating step performed before operation, it is preferable that 100 or more vibrations are repeatedly applied to the piezoelectric element by the piezo actuator.

Further, in the vibrating step during the discharging step, it is preferable that 10 to 50 vibrations are repeatedly applied to the piezoelectric element by the piezo actuator.

Thereby, the discharge defect of ink can be prevented securely before operation or between printings.

In the method for controlling an inkjet printing apparatus, by performing the vibrating step to all the nozzles, a discharge defect of ink can be prevented in all the nozzles.

Particularly, in the apparatus, since the printing head is the line head of a fixed type, as described above, the printing head itself does not move even during operation.

Therefore, a discharge defect preventing effect obtained by the vibrating step performed to nozzles in non-use is considerably high.

Further, since the vibrating step is not required to be set to each of the nozzles, the printing data can be made simple.

In the method for controlling an inkjet printing apparatus, the non-image portion B is set with a fixed cycle. Thereby, the vibrating step can be controlled simply, and production of the printing data is made easy.

It should be noted that since the vibrating step is not performed in a region between papers but it is performed to the non-image portion B of the elongated printing medium 11 which does not cause a deviation of the feeding of the printing medium 11, it is made possible to set the vibrating step with a fixed cycle.

Incidentally, when the vibrating step is performed in a region between papers (between individual paper pieces), since an interval between paper pieces is not constant necessarily due to a feeding error, the vibrating step cannot be set with such a fixed cycle.

FIGS. 6(*a*) and 6(*b*) are descriptive diagrams for describing a processing method performed when an image has entered in a non-image portion of printing data in the method for controlling an inkjet printing apparatus according to the embodiment.

As described above, the non-image portion B is a region where ink is not discharged so that an image is not formed as a principle, but there is such a case that when the non-image portion B is set with a fixed cycle, as shown in FIG. 6(*a*), an image is included in a portion of the non-image portion B.

In this case, in the method for controlling an inkjet printing apparatus, the discharging step is prioritized to only the portion corresponding to the image, while the other portion of the non-image portion B is subjected to the vibrating step. Thereby, the production efficiency can be prevented from lowering.

Further, as another example, it is possible to make a region of the non-image portion B including an image small and print a portion corresponding to the image as the image portion A, as shown in FIG. 6(*b*).

Thereby, the production efficiency can be prevented from lowering.

Figure 7:
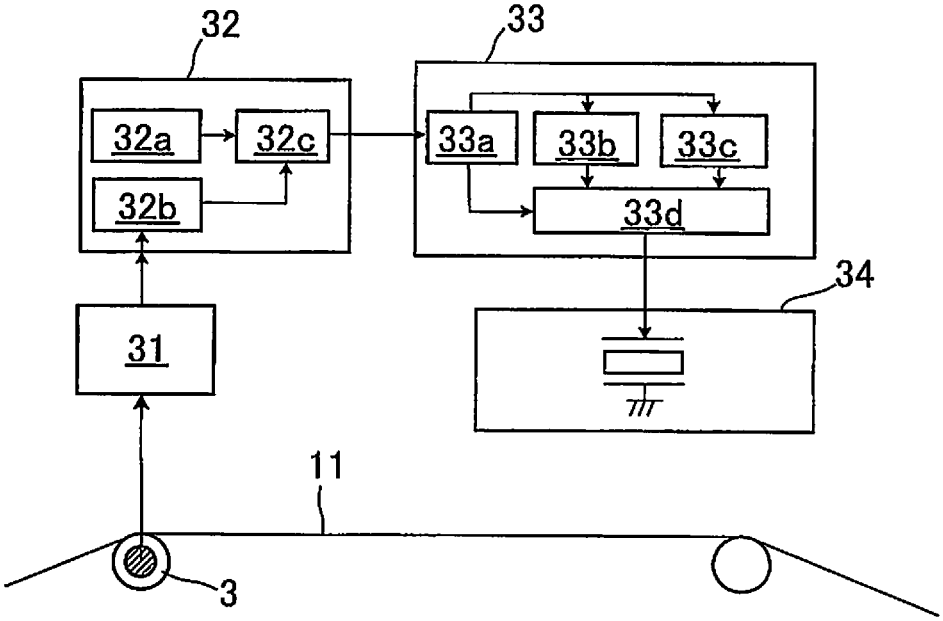
FIG. 7 is a flowchart showing a flow of the method for controlling an inkjet printing apparatus according to the embodiment.

FIG. 7 is a flowchart showing a flow of the method for controlling an inkjet printing apparatus according to the embodiment.

As shown in FIG. 7, in the method for controlling an inkjet printing apparatus, an encoder 3 is attached to a guide roll for feeding the printing medium 11.

The encoder 3 measures a paper feeding amount, and transmits a first signal of the measurement to a page start signal generator 31, so that the page start signal generator 31 transmits a print start signal to a control unit 32 upon receipt of the first signal.

The control unit 32 is provided with an image data development portion 32*a* for developing image data to produce image data, a pre-vibration insertion determination portion 32*b* determining whether or not the vibrating step is performed, and a data transmission portion 32*c*.

In the control unit 32, when the pre-vibration insertion determination portion 32*b* receives a print start signal, it determines whether or not a vibrating step should be performed, and transmits information about the determination to the data transmission portion 32*c*.

On the other hand, the image data development portion 32*a* transmits the produced image data information to the data transmission portion 32*c*.

Then, the data transmission portion 32*c* transmits a second signal including this information to a data reception portion 33*a* of the image-rendering portion 33.

It should be noted that when printing is performed on a page unit, a signal produced for each page by the page start signal generator 31 based upon the encoder 3 is transmitted to the control unit 32.

The pre-vibration insertion determination portion 32*b* determines one of a margin region of a previous page side of the page border L (see FIG. 3(*b*)), a margin region of the next page side thereof, and a margin region connecting these page sides to be applied with the vibrating step to transmit the determination to the data transmission portion 32*c*.

The image-rendering portion 33 has a data reception portion 33*a*, a discharge waveform producing portion 33*b* setting a discharging step to an image portion, a pre-vibration producing portion 33*c* setting a vibrating step to a non-image portion, and a selector 33*d* determining whether the discharging step or the vibrating step is performed.

In the image-rendering portion 33, when the data reception portion 33*a* receives a second signal, it transmits printing data information contained in the second signal to the discharge waveform producing portion 33*b* and the pre-vibration producing portion 33*c*, and also transmits a printing start signal to the selector 33*d*.

Further, the discharge waveform producing portion 33*b* transmits discharge information composed of a waveform shown in FIG. 4 to the selector 33 based upon the printing data information and the pre-vibration producing portion 33*c* transmits vibration information composed of a waveform shown in FIG. 5 to the selector 33*d* based upon the printing data information.

The selector 33*d* transmits a third signal including this information to the piezo actuator 34. It should be noted that in such a case that the non-image portion B is set with a fixed cycle, when an image is present in the non-image portion B, the selector 33*d* performs the discharging step for the image preferentially.

The piezo actuator 34 applies a voltage to the piezoelectric element of the printing head based upon the received third signal, so that the above-described discharging step or vibrating step is performed.

Though the embodiment of the present invention has been described above, the present invention is not limited to the above embodiment.

For example, in the method for controlling an inkjet printing apparatus according to the embodiment, the image portions A and the non-image portions B of the printing data are set at such positions as shown in FIGS. 3(*a*) and 3(*b*), but positions to which the image portions A and the non-image portions B are to be set are not limited to these positions.

That is, since the printing data is produced based upon the image data, when the image data is replaced by other image data, positions set with the image portions A and the non-image portions B are also changed.

In the method for controlling an inkjet printing apparatus according to the embodiment, the image portions A and the non-image portions B of the printing data have been shown in FIGS. 3(*a*) and 3(*b*), but positions to which the image portions A and the non-image portions B are to be set are not limited to the positions shown in FIGS. 3(*a*) and 3(*b*), but they may be determined arbitrarily.

In the method for controlling an inkjet printing apparatus according to the embodiment, the non-image portions are set with a fixed cycle, but the cycle is not required to be set with a fixed cycle necessarily.

In the method for controlling an inkjet printing apparatus according to the embodiment, when printing is performed for each page by performing sectioning at the page border L, a margin of the previous page side is set as the non-image portion (see FIG. 6(*b*)), but it is possible to set a margin of the next page side, a margin connecting the previous page side and the next page side or the like as the non-image portion.

INDUSTRIAL APPLICABILITY

The present invention is used as a controlling method using an inkjet printing apparatus of a piezo type ejecting ink onto a printing medium to form an image. According to the controlling method of the present invention using an inkjet printing apparatus, nozzle discharge defects in all nozzles can be prevented and the production efficiency is excellent.

REFERENCE SIGNS LIST

3 . . . encoder,
10 . . . printing head,
11 . . . printing medium,
20 . . . nozzle,
21 . . . opening portion,
22 . . . ink chamber,
23 . . . piezoelectric element,
24 . . . vibrating plate,
31 . . . page start signal generator,
32 . . . control unit,
32*a* . . . image data development portion,
32*b* . . . pre-vibration insertion determining portion,
32*c* . . . data transmission portion,
33 . . . image-rendering portion,
33*a* . . . data reception portion,
33*b* . . . discharge waveform producing portion,
33*c* . . . pre-vibration producing portion,
33*d* . . . selector,
34 . . . piezo actuator,
A . . . image portion, and
B . . . non-image portion

The invention claimed is:

1. A method for controlling an inkjet printing apparatus which performs printing on an elongated printing medium, the inkjet printing apparatus being provided with a printing head having a plurality of nozzles composed of an opening portion from which ink is discharged, an ink chamber communicating with the opening portion to accommodate ink, and a piezoelectric element attached to the ink chamber via a vibrating plate and with a selector for adjusting a time period of application to the piezoelectric element, the method comprising:

a discharging step of performing continuous application to a piezoelectric element of a nozzle to be used with a pulse number equal to or more than two waves per one printing pixel to deform the piezoelectric element and discharge ink in the ink chamber from the opening portion; and a vibrating step of performing application to the piezoelectric elements of all nozzles with a pulse number of one wave per one printing pixel to deform the piezoelectric elements, thereby imparting only vibrations to the inks in the ink chambers without discharging the inks, wherein in the discharging step and the vibrating step, voltages to be applied are fixed, and the application times of the voltages are controlled, the discharging step and the vibrating step are performed alternately, the vibrating step is first performed prior to the discharging step of the inkjet printing apparatus, the vibrating step prior to the discharging step is performed for a time period longer than the vibrating step performed after the discharging step, and in the vibrating step performed before the discharging step, 100 or more vibrations are applied to the piezoelectric element by the piezo actuator, and in the vibrating step after the discharging step, 10 to 50 vibrations are applied to the piezoelectric element by the piezo actuator.

2. The method for controlling an inkjet printing apparatus according to claim 1, wherein the printing head is a line head of a fixed type.

3. The method for controlling an inkjet printing apparatus according to claim 1, wherein the vibrating step is a step for continuously applying vibrations for a fixed time period.

4. The method for controlling an inkjet printing apparatus according to claim 1, wherein the inkjet printing apparatus is an apparatus configured so as to perform printing based upon printing data having an image portion and a non-image portion, the discharging step is set so as to be performed to the image portion, and the vibrating step is set so as to be performed to the non-image portion.

5. The method for controlling an inkjet printing apparatus according to claim 4, wherein the non-image portion is set with a fixed cycle.

6. The method for controlling an inkjet printing apparatus according to claim 4, wherein the non-image portion is set with a fixed cycle as much as possible and when an image is present in the non-image portion, the discharging step is prioritized to only a portion corresponding to the image and the vibrating step is set to the other portion of non-image portion.

7. The method for controlling an inkjet printing apparatus according to claim 4, wherein the printing is performed at a page unit, and a margin of a previous page side, a margin of the next page side, or a margin connecting the previous page side and the next page side is set as the non-image portion.

* * * * *